US012434789B2

(12) United States Patent
Hasselskog

(10) Patent No.: US 12,434,789 B2
(45) Date of Patent: Oct. 7, 2025

(54) HYDROFOIL BOAT

(71) Applicant: Candela Speed Boat AB, Lidingö (SE)

(72) Inventor: Gustav Hasselskog, Stockholm (SE)

(73) Assignee: Candela Technology AB, Lidingö (SE)

( * ) Notice: Subject to any disclaimer, the term of this patent is extended or adjusted under 35 U.S.C. 154(b) by 503 days.

(21) Appl. No.: 18/004,433

(22) PCT Filed: Jul. 2, 2021

(86) PCT No.: PCT/SE2021/050671
§ 371 (c)(1),
(2) Date: Jan. 5, 2023

(87) PCT Pub. No.: WO2022/010402
PCT Pub. Date: Jan. 13, 2022

(65) Prior Publication Data

US 2023/0294796 A1 Sep. 21, 2023

(30) Foreign Application Priority Data

Jul. 6, 2020 (SE) ..... 2050857-8
Sep. 18, 2020 (SE) ..... 2051092-1

(51) Int. Cl.
*B63B 1/26* (2006.01)
*B63B 1/24* (2020.01)
*B63H 5/125* (2006.01)

(52) U.S. Cl.
CPC ..... *B63B 1/26* (2013.01); *B63B 1/246* (2013.01); *B63H 2005/1258* (2013.01)

(58) Field of Classification Search
CPC ... B63B 1/26; B63B 1/246; B63H 2005/1258; B63H 5/10
See application file for complete search history.

(56) References Cited

U.S. PATENT DOCUMENTS 2,984,197 A 5/1961 Bader
3,081,728 A 3/1963 Wilterdink et al.
(Continued)

FOREIGN PATENT DOCUMENTS

CA 2839130 A1 12/2012
CN 103781701 A 9/2016
(Continued)

OTHER PUBLICATIONS

Chinese search report issued in CN application 2021800480276 issued Apr. 25, 2025.
(Continued)

*Primary Examiner* — Anthony D Wiest
(74) *Attorney, Agent, or Firm* — Schott, P.C.

(57) ABSTRACT

The invention involves a boat comprising —a hull (2), —a first hydrofoil (301) fastened to the hull (2) by means of a first fastening arrangement (302), and —a second hydrofoil (601) fastened to the hull (2) by means of a second fastening arrangement (503) which is separate from the first fastening arrangement (302), —wherein the second fastening arrangement comprises a strut (503) arranged to extend at least partly downwards from the hull (2), the second hydrofoil being fixed to the strut, —wherein that the boat comprises a motor pod (502) fixed to the strut (503), —wherein the strut and the motor pod are turnable in relation to the hull for steering the boat, —wherein the motor pod comprises a casing, a power supply assembly housed in the casing, and two propellers arranged to be driven by the power supply assembly, —wherein the propellers (5011, 5012) are counter-rotating.

19 Claims, 6 Drawing Sheets

(56) References Cited

U.S. PATENT DOCUMENTS

| | | | | |
|---|---|---|---|---|
| 3,183,871 | A | 5/1965 | Reder | |
| 3,270,699 | A | 9/1966 | Bush | |
| 4,862,820 | A | 9/1989 | Guezou et al. | |
| 11,667,352 | B2 * | 6/2023 | Leason | B63B 1/283 114/275 |
| 2002/0124783 | A1 * | 9/2002 | Dynes | B63B 34/40 114/55.54 |
| 2011/0259254 | A1 | 10/2011 | Coffman | |
| 2018/0072383 | A1 | 3/2018 | Montague et al. | |
| 2018/0354592 | A1 | 12/2018 | Chaves | |
| 2019/0389553 | A1 | 12/2019 | Mudupu et al. | |

FOREIGN PATENT DOCUMENTS

| | | | |
|---|---|---|---|
| CN | 210592390 | U | 5/2020 |
| CN | 107150760 | A | 10/2023 |
| EP | 3168126 | A1 | 5/2017 |
| GB | 1416531 | A | 12/1975 |
| JP | H05178268 | A | 7/1993 |
| JP | H05254488 | A | 10/1993 |
| KR | 800000201 | B1 | 3/1980 |
| WO | WO2008032167 | A1 | 3/2008 |
| WO | 2018002383 | A1 | 1/2018 |
| WO | WO2018229355 | A1 | 12/2018 |
| WO | 2020056530 | A2 | 3/2020 |
| WO | 2020094329 | A1 | 5/2020 |

OTHER PUBLICATIONS

European Search Report for related EP 21837259 issued Sep. 10, 2024.

International Search Report Issued within the Patent Cooperation Treaty International Application No. PCT/SE2021/050671, mailed Sep. 8, 2021, 5 pages.

Written Opinion issued from the International Searching Authority within the Patent Cooperation Treaty International Application No. PCT/SE2021/050671, completed Sep. 8, 2021, 4 pages.

Candela Seven Product Presentation—"We build electrical performance craft".; YouTube online video; Apr. 14, 2020 [retrieved on Sep. 3, 2021] Retrieved from https://youtu.be/2mZZZIZVvHw.

Candela electrical hydrofoil—from the beginning, YouTube online video; Apr. 23, 2017 [retrieved on Sep. 3, 2021] Retrieved from https://youtu.be/WnrRgX2LaX8.

Mckay Ryan S; Kingan Michael J; Go Sung Tyaek; Jung Riul; Experimental and analytical investigation of contra-rotating multi-rotor UAV propeller noise; Applied Acoustics published Jun. 1, 2021.

Zhao Longfei; Shkarayev Sergey; Characterization of ducted contra-rotating propeller propulsions; International Journal of Micro Air Vehicles published Jan. 1, 2019.

* cited by examiner

HYDROFOIL BOAT

TECHNICAL FIELD

The invention relates to a boat comprising a hull, a first hydrofoil fastened to the hull by means of a first fastening arrangement, and a second hydrofoil fastened to the hull by means of a strut which is separate from the first fastening arrangement.

BACKGROUND

For the propulsion of marine vessels, for example pleasure boats, internal combustion engines are still dominating, despite environmental and noise problems. The engines could be e.g. inboard, or outboard engines. The mode of progress of a non-hydrofoil boat may, if enough power capacity is available for its propulsion, be transformed from a displacement mode to a planning mode. By means of hydrofoils, a boat can assume a hydrofoil mode of progress. At the hydrofoil mode, the hull is lifted out of the water, and, compared to a planning mode, the propulsion power requirement is considerably lower, e.g. in the order of 50% less. There is nevertheless a desire to further decrease the power requirements of boats. This may be done by reducing the boat drag.

SUMMARY

An object of the invention is to reduce the drag of a hydrofoil boat.

The object is achieved with a boat comprising a hull, wherein the boat further comprises a first hydrofoil fastened to the hull by means of a first fastening arrangement, and a second hydrofoil fastened to the hull by means of a second fastening arrangement which is separate from the first fastening arrangement. The second fastening arrangement comprises a strut arranged to extend at least partly downwards from the hull, the second hydrofoil being fixed to the strut. The boat comprises a motor pod fixed to the strut, wherein the strut and the motor pod are turnable in relation to the hull for steering the boat. The motor pod comprises a casing, a power supply assembly housed in the casing, and two propellers arranged to be driven by the power supply assembly. The propellers are counter-rotating.

Thereby, the boat may be a hydrofoil boat. The motor pod allows omitting mechanical power transmitting assemblies, such as propeller shafts, extending from the hull to the propellers. In addition, the relatively low propulsion power requirement provided by the hydro-foil mode, means that the volume of the motor pod motor may be relatively small while providing enough power for this mode. Thereby, the drag of the boat may be decreased.

Also, the torque being distributed to each of two propellers allows, compared to a single propeller, a higher total torque, and thereby more available power for the boat propulsion.

In addition, the strut holding the second hydrofoil may be relatively long and slender. By the counter-rotating propellers, torques around a roll axis of the boat, caused by the propellers, may cancel each other. The roll axis is understood as an axis that is substantially parallel to a direction of straight forward travel of the boat. By the counterrotating propellers cancelling the torques of the propellers, bending moments otherwise caused by propeller torques may be reduced or eliminated. Thereby, the strength requirements on the strut may be reduced, so that the strut may be slender. Thereby, the boat drag is reduced.

Also, the strut and the motor pod may be turned in relation to the hull so as to steer the boat. Thus, the strut with the motor pod and the second hydrofoil is turnable in relation to the hull for steering the boat. By being turnable the strut may be rotatable. With a single propeller, a gyroscopic effect occurring when the strut is turned, may cause deflections in the strut. Such deflections may be reduced by adding material or dimensions to the strut. However, with added dimensions, an added drag will follow. With two counterrotating propellers, such a gyroscopic effect is cancelled, and strut deflections caused thereby may be avoided. Thereby, the strut may be kept slender, whereby the drag thereof is kept low.

The first fastening arrangement may comprise one, two, or more first struts, each extending from the hull to the first hydrofoil. The first hydrofoil may be fixed to the first fastening arrangement. However, as exemplified below, the first hydrofoil may be fastened to, but movable in relation to, the first fastening arrangement.

The first hydrofoil may be a main hydrofoil. Thereby, the first hydrofoil may be adapted to carry a major part of the mass of the boat. In some embodiments, the first hydrofoil is located at or in the vicinity of a center of gravity of the boat.

The second hydrofoil may be fixed to the second fastening arrangement. The second fastening arrangement may comprise one or more struts extending between the hull and the second hydrofoil. Such a strut of the second fastening arrangement is herein also referred to as a second strut.

Preferably, the second hydrofoil is located behind the first hydrofoil as seen in a direction of straight forward travel of the boat. Thereby, the second hydrofoil may also be referred to as an aft hydrofoil. Thereby, the second fastening arrangement may be located behind the first fastening arrangement as seen in a direction of straight forward travel of the boat. This provides a beneficial location of the motor pod, which is fixed to the second fastening arrangement.

However, in some embodiments, the second fastening arrangement, with the second hydrofoil, and the motor pod, may be located in front of the first hydrofoil as seen in a direction of straight forward travel of the boat.

The boat may be a pleasure boat. However, the boat may alternatively be adapted for professional transport of passengers and/or goods.

Preferably, the power supply assembly comprises two electric motors housed coaxially in the casing. It is understood that in use, the motor pod is submerged in the water carrying the boat. Therefore, providing the motors in the motor pod allows a reduced noise level. Also, the surrounding water may effectively cool the motors. Further, electric motors can be relatively small, e g compared to hydraulic motors, reducing the cross-sectional area of the motor pod, thereby reducing the drag.

The two propellers may each arranged to be driven by a respective of the motors. Preferably, the propellers are each arranged to be driven directly by a respective of the motors without a gear arrangement. Thereby, no lubricant is needed for the drive of the propellers. Thereby, long service intervals for the motor pod may be provided. Also, the absence of gear arrangements allows a reduced noise level, and a less complicated assembly for driving the propellers.

The motors may be positioned one after the other in a longitudinal direction of the motor pod, (i.e. in a direction of an axis of rotation of the propellers). As mentioned, the propellers are counter-rotating.

By the distribution of the torque to two propellers, the torque requirement on each motor is reduced, allowing a smaller motor size, and thereby a reduced motor casing diameter. Also, a smaller propeller diameter is made possible, allowing a higher rotational speed, thereby reducing the motor torque requirement, without changing the available power. Thereby, a reduced motor casing diameter is allowed.

In general, one or more motors may be provided in the motor pod. In some embodiments, the power supply assembly comprises a single electric motor arranged to drive both propellers. Thereby, a gearing may be provided for one of the propellers for the counter-rotation of the propellers. Preferably, where casing preferably has a cylindrical outer surface, the one or more motors are housed concentrically in the casing.

The motor torque density may be increased, and thereby the motor volume may be further decreased, by optimizing the motor heat dissipation. Each motor may be a permanent magnet motor. The inner rotor of each motor may contain magnets, and the outer stator may contain heat generating coils. The stator may be connected to the motor pod casing so that heat generated by the motor is conducted to an outer surface of the casing. Thereby the heat may be transmitted to the surrounding water. Preferably, the casing is made in a material, e.g. a metal such as bronze, brass or stainless steel, having a relatively high thermal conductivity. Thereby, the casing may provide an effective cooling of the one or more motors by the surrounding water.

The diameter of each propeller is preferably 180-350 mm, for example, around 230 mm. Where two propellers are provided, the combined length of the propeller hubs is preferably 100-300 mm, preferably 130-250 mm, for example, around 180 mm. The casing preferably has a cylindrical outer surface. Thereby, the entire casing may have a cylindrical outer surface, or one or more portions of the casing may have a cylindrical surface. Preferably, the cylindrical outer surface of the casing has a diameter of 80-140 mm, for example around 105 mm. The ratio between the length of the motor pod and the casing outer diameter is preferably at least 5, preferably at least 7, for example around 9.5. The diameter of each motor is preferably 70-130 mm, for example around 95 mm. The length of each motor is preferably 130-240 mm, for example around 180 mm. Thereby, the length to diameter ratio of the motors is relatively high, allowing a reduced drag. Also, an increase of the motor heat dissipation is allowed, since a relatively high ratio of the exposed surface to motor volume is provided. Preferably, the ratio between the diameter of each motor and the casing outer diameter is at least 0.8, preferably at least 0.85, for example around 0.9.

Preferably, the length of the motor pod is 700-1400 mm, for example around 1000 mm. Preferably, the ratio between the length of the motor pod and the casing outer diameter is at least 5, preferably at least 7, for example around 9.5. Preferably, the ratio between the length of the motor pod and the casing outer diameter is no more than 13, preferably no more than 17. Preferably, where two propellers are provided, the ratio between the combined length of the propeller hubs and the length of the motor pod is 0.09-0.36, preferably 0.12-0.26, preferably 0.15-0.22.

Preferably, at cruising speed, the rotational speed of each motor is 1500-3500 rpm, for example around 2200 rpm. Preferably, maximum torque of each motor is 60-130 Nm, for example around 90 Nm.

Where the motor pod comprises two motors, the motor shafts may be arranged concentrically, one within the other. Preferably the inner shaft has a diameter of 14-28 mm, for example around 20 mm Preferably the outer shaft has a diameter of 25-48 mm, for example around 35 mm.

The volume of an electric motor increases proportionally to the torque at a given magnetic loading. Hence, the volume of an electric motor increases proportionally to the maximum torque of the motor. Therefore, the hydrofoil mode, with a relatively low power requirement, allows for a relatively low volume of the electric motors. The low motor volume allows for a relatively low casing volume. Further, relatively long and narrow motors, and/or motors positioned one after the other in a longitudinal direction of the motor pod, allows for the motor volume to be distributed largely in a longitudinal direction of the motor pod, with a relatively low area of the motor pod lateral cross-section. In a pushing configuration of the motor pod, this allows for a relatively small propeller diameter, without any risk of flow disturbance at the propellers caused by the casing. The relatively small propeller diameter avoids the risk of propeller blade tip cavitation (which may occur at around 45 m/s). Thereby, with a relatively small amount of power, a relatively high Froude number may be achieved. (The Froude Number, Fr, can be expressed as $Fr=v/(g\ h_m)^{1/2}$, where v=velocity, g=acceleration of gravity, and $h_m$=characteristic length.)

As mentioned, the second fastening arrangement comprises a strut arranged to extend at least partly downwards from the hull, the second hydrofoil being fixed to the strut. The strut may extend substantially straight downwards from the hull when the boat is floating in an upright condition. As mentioned, the motor pod is fixed to the strut. The motor pod may be fixed to the strut at a lower end of the strut. Alternatively, the motor pod may be fixed to the strut above a lower end of the strut.

Preferably, the boat comprises a strut mounting arrangement for fixing the strut to the hull, wherein the strut is, by means of one or more strut bearings, pivotally connected to the strut mounting arrangement so that the strut may be turned in relation to the hull. Thus, thereby the strut may, with the second hydrofoil and the motor pod, be turned in relation to the hull. Thereby, the strut with the motor pod may be controlled so as to steer the boat. The strut may be turned around an axis which is substantially parallel with a major extension of the strut. The turning axis may be substantially vertical when the propulsion device is mounted to the boat, and when the boat is floating in an upright condition. Thus, the strut may be turned in relation to the hull around an axis which is substantially vertical when the boat is floating in an upright condition.

The strut may extend 0.7-2.0 meters between the one or more strut bearings and the motor pod. Preferably, the ratio between, on one hand the strut extension between the one or more strut bearings and the motor pod, and on the other hand the diameter of each propeller, is at least 2.0, preferably at least 3.9, preferably at least 5.7. Preferably, the ratio between, on one hand the strut extension between the one or more strut bearings and the motor pod, and on the other hand the diameter of a cylindrical outer surface of the casing, is at least 5.0, preferably at least 8.0, preferably at least 14.0.

In some embodiments, the strut of the second fastening arrangement is arranged to be tilted around an axis which is substantially horizontal when the boat is floating in an upright condition, and substantially lateral to a direction of straight travel of the boat. The second hydrofoil may be fixed to the strut. The motor pod may be fixed to the strut. The strut may be arranged to be tilted backwards. Thereby, the strut may the tilted to reduce the draft of the boat, and/or to move the motor pod out of the water, e.g. when docking.

Also, tilting of the strut may be used to trim the boat when travelling in a hydrofoil mode of progress.

In some embodiments, the strut of the second fastening arrangement is arranged to be tilted around an axis which is substantially horizontal when the boat is floating in an upright condition, and substantially parallel with a direction of straight travel of the boat.

Preferably, the second hydrofoil is located above the motor pod when the boat is floating in an upright condition. Thereby, the second hydrofoil may be fixed to the strut between the motor pod and the one or more strut bearings. The location of the second hydrofoil above the motor pod may have an advantageous effect on the propeller(s) of the motor pod. Also, the second hydrofoil may prevent air, from above the surface of the surrounding water, from being sucked down to the propeller(s). Preferably, the ratio of, on one hand, the vertical distance between a rotational axis of the propeller(s) and the second hydrofoil, and, on the other hand, the vertical distance between the rotational axis of the propeller(s) and the one or more strut bearings, is 0.09-0.19, preferably 0.12-0.16, for example 0.14.

In some embodiments, the second hydrofoil and the motor pod are at the same position along the strut.

The strut of the second fastening arrangement may comprise a lower strut part and an upper strut part. Thereby, the second hydrofoil may be mounted to the strut, between the lower and upper strut parts. The lower strut part may extend between motor pod and second hydrofoil. The second hydrofoil may be provided as a single component extending between two foil tips. The second hydrofoil may extend, in a spanwise direction between the foil tips, perpendicularly to a direction of straight forward travel of the boat, and horizontally when the boat is floating at rest in an upright condition. The second hydrofoil may extend at least partly through the strut. The second hydrofoil may be mounted to the strut at a region between the foil tips, preferably in the middle between the foil tips.

Thereby a rigid mounting of the second hydrofoil to the strut may be provided. In particular, the second hydrofoil may be mounted to the strut, between the lower and upper strut parts, while extending between the foil tips. The lower strut part may be made out the same material as the motor pod casing, such as metal, e.g. bronze, brass or stainless steel. Thereby, the lower strut part and the casing may be formed in a single piece, e.g. by casting. This facilitates the manufacturing of an interface between the strut and the casing. The upper strut part may be made of a material which is different from that of the lower strut part. For example, the upper strut part may be made of a fiber reinforced plastic material, such as a glass and/or carbon fiber reinforced plastic material. Thereby, the upper strut part can be provided with a high stiffness to weight ratio, and/or a high strength to weight ratio. Also, service and repair of the motor pod, the strut, and/or the second hydrofoil, may be facilitated. In particular, the lower strut part may be demounted from the upper strut part, making the second hydrofoil easy to access, for replacement or repair.

Preferably, a trailing edge of the strut merges into a fin on the motor pod. The fin may gradually decrease in height towards the propellers. Preferably, the ratio of the horizontal extension of the fin to the maximum vertical extension of the fin is preferably at least 1.5, more preferably at least 2.2, for example about 2.7. Thereby, the joint between the strut trailing edge and the motor pod may be provided over a relatively long distance in a direction with is parallel to the relative water free-flow. Thereby, the risk of cavitation, due to an increased relative water velocity at the strut, and hence a decreased pressure, may be avoided. In some embodiments, the ratio of the horizontal extension of the fin to the maximum vertical extension of the fin is preferably at least 3.0, at least 4.0, or at least 5.0.

Preferably, the motor pod is arranged to be more submerged than the first hydrofoil when the boat is travelling straight forward, and when the hull is carried by the first and second hydrofoils. Thereby, there the motor pod is located behind the first hydrofoil, water reaching the propeller(s) may be undisturbed by the first hydrofoil.

Preferably, the first hydrofoil is a submerged type hydrofoil. The second hydrofoil may also be a submerged type hydrofoil. A submerged, or immersed hydrofoil, is a foil that is designed to be fully submerged during a cruising mode of the boat. A submerged type hydrofoil may have an adjustable pitch orientation so as to change the angle of attack of the hydrofoil. A submerged type hydrofoil may, for a roll stability of the boat, be arranged to be controlled so as to present different lift coefficients, and/or different angles of attack, along the length of the foil. Roll may be defined as a movement around a roll axis which is substantially parallel to a direction of forward travel of the vessel. The roll axis could extend within a hull symmetry plane, and it could be substantially horizontal.

Making the first hydrofoil a submerged type hydrofoil further reduces the resistance of a pod-electric-propulsion boat, which in turn allows reduced power requirements and a smaller diameter motor housing, it turn additionally reducing resistance.

However, in some embodiments, the first hydrofoil type is a surface piercing hydrofoil. In some embodiments, the second hydrofoil type is a surface piercing hydrofoil.

Further advantages and advantageous features of the invention are disclosed in the following description and in the dependent claims.

BRIEF DESCRIPTION OF THE DRAWINGS

Below, embodiments of the invention will be described with reference to the drawings, in which.

DETAILED DESCRIPTION OF EMBODIMENTS OF THE INVENTION

Figure 1:
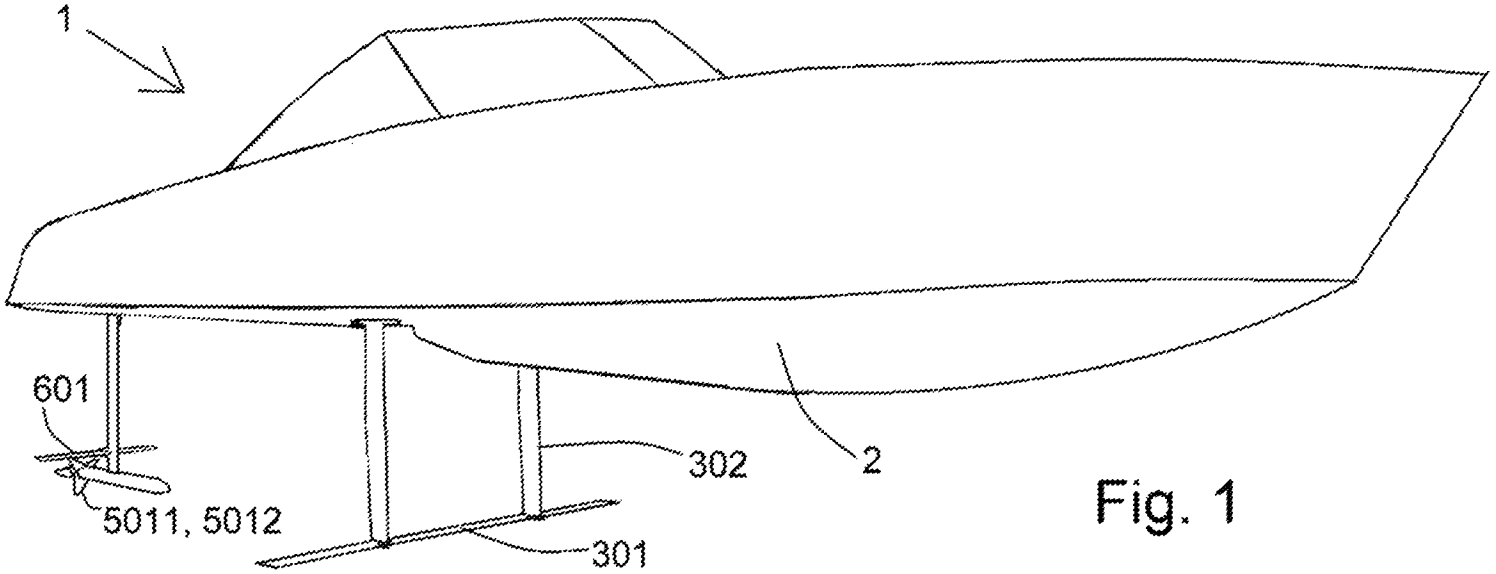
FIG. 1 shows a perspective view a boat according to an embodiment of the invention.
Figure 2:
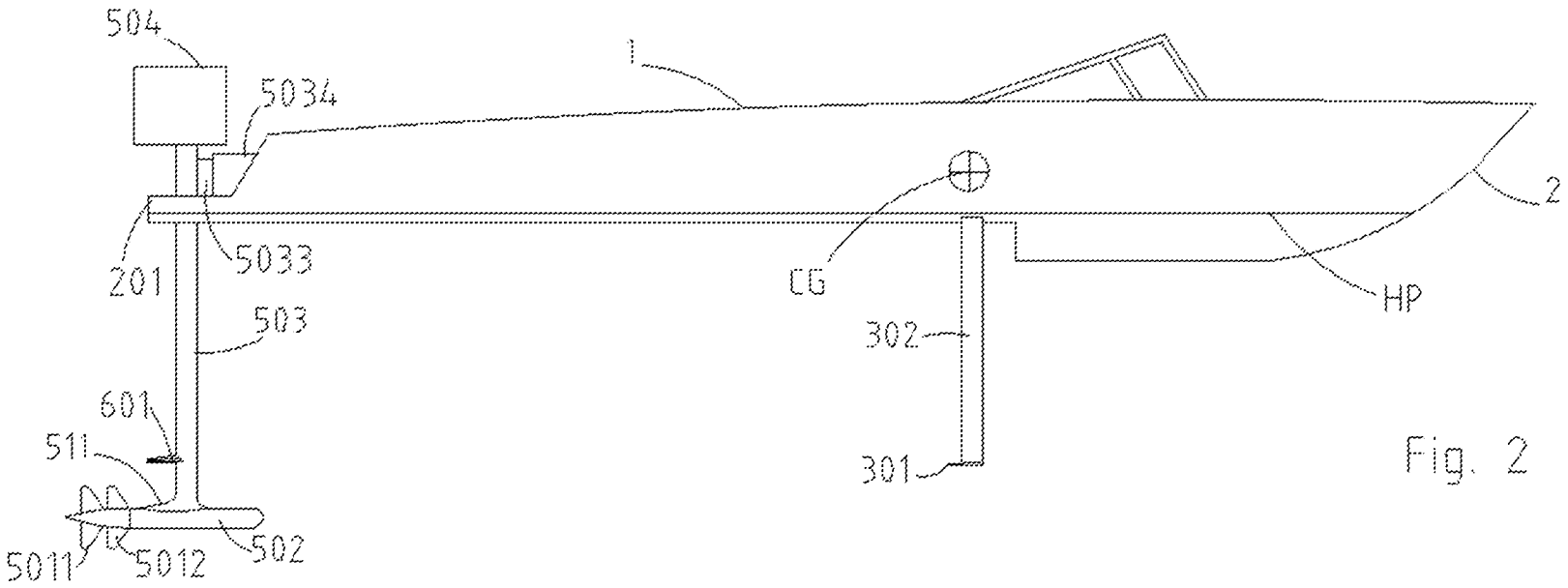
FIG. 2 shows a side view of the boat in FIG. 1.
Figure 3:
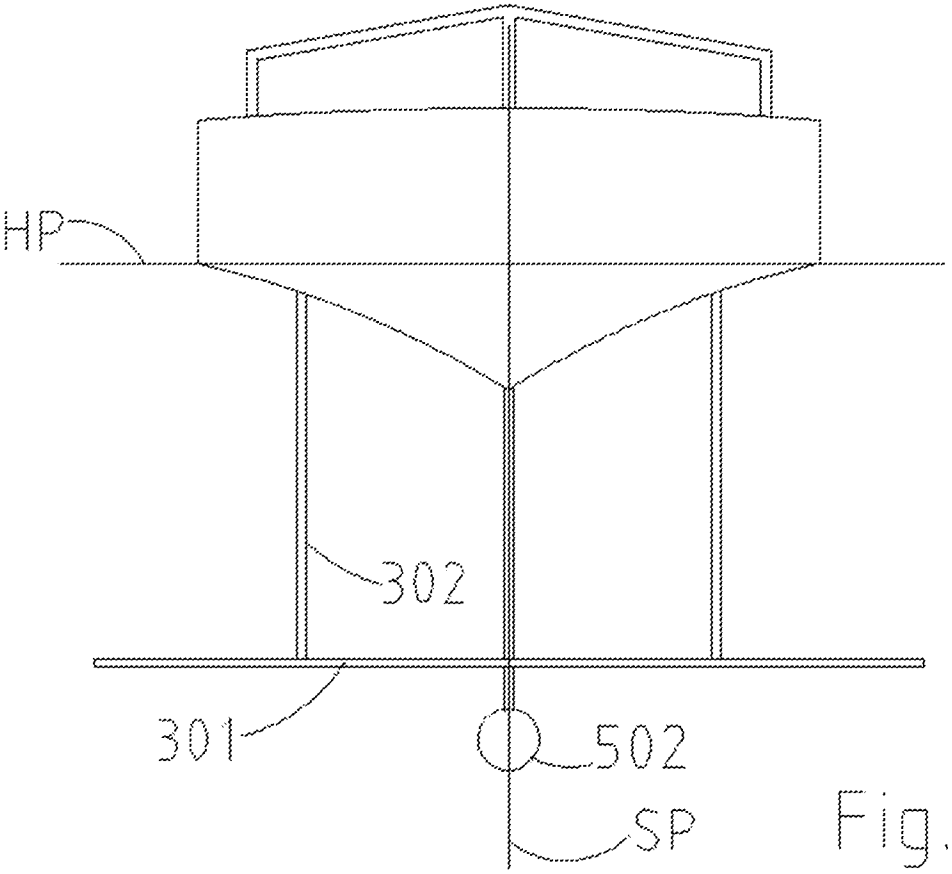
FIG. 3 shows a view of the boat in FIG. 1 from in front of the boat, FIG. 4 shown a vertical and longitudinal cross-section of a motor pod of the boat in FIG. 1, and FIG. 5 and FIG. 6 show respective side views of respective boats according to alternative embodiments of the invention.

FIG. 1-FIG. 3 show a hydrofoil boat 1. The boat comprises a hull 2. As can be seen in FIG. 3, the hull 2 presents, when the boat is floating at rest, an imaginary vertical symmetry plane SP, and an imaginary horizontal plane HP coinciding with a waterline of the hull 2.

The boat comprises a first hydrofoil 301 fastened to the hull 2 by means of a first fastening arrangement 302. The first hydrofoil 301 is a submerged type hydrofoil. The first hydrofoil 301 has an adjustable pitch orientation so as to change the angle of attack of the first hydrofoil. The first hydrofoil 301 is connected to the hull by means of the first fastening arrangement 302. The first fastening arrangement 302 comprises two foil holding members 302. The foil holding members 302 are in the form of struts, herein also referred to as first struts. The first hydrofoil 301 may be, as exemplified in FIG. 2, in the direction of travel of the boat 1, located substantially at a center of gravity CG of the boat.

In some embodiments, the boat does not comprise an adjustable hydrofoil. In some embodiments, the boat comprises a surface piercing first hydrofoil.

The boat also comprises a second hydrofoil 601. The second hydrofoil 601 is a submerged type hydrofoil. The second hydrofoil is fastened to the hull 2 by means of a second fastening arrangement 503. The second fastening arrangement 503 is separate from the first fastening arrangement 302. The second fastening arrangement comprises a strut 503 arranged to extend downwards from the hull 2. The second hydrofoil is fixed to the strut. The strut is fastened to the hull at a stern of the hull. The second hydrofoil is located behind the first hydrofoil 301 as seen in a direction of straight forward travel of the boat. The second hydrofoil is arranged to support, in a hydrofoil driving mode, an aft part of the hull.

The hull 2 in this embodiment comprises a stern extension 201. The strut 503 extends through an opening or a recess (not shown) in the stern extension. In some embodiments, the strut 503 is mounted on a transom of the hull. In other embodiments, the strut extends through an opening in the hull, between the stern of the boat and the first fastening arrangement 302.

The boat also comprises a motor pod 502. The motor pod 502 is fixed to the strut 503. Thus motor pod 502 is provided below the stern of the hull. The motor pod 502 is located below the second hydrofoil 601 when the boat is floating in an upright condition. The length MPL of the motor pod is in this example 1000 mm.

Figure 4:
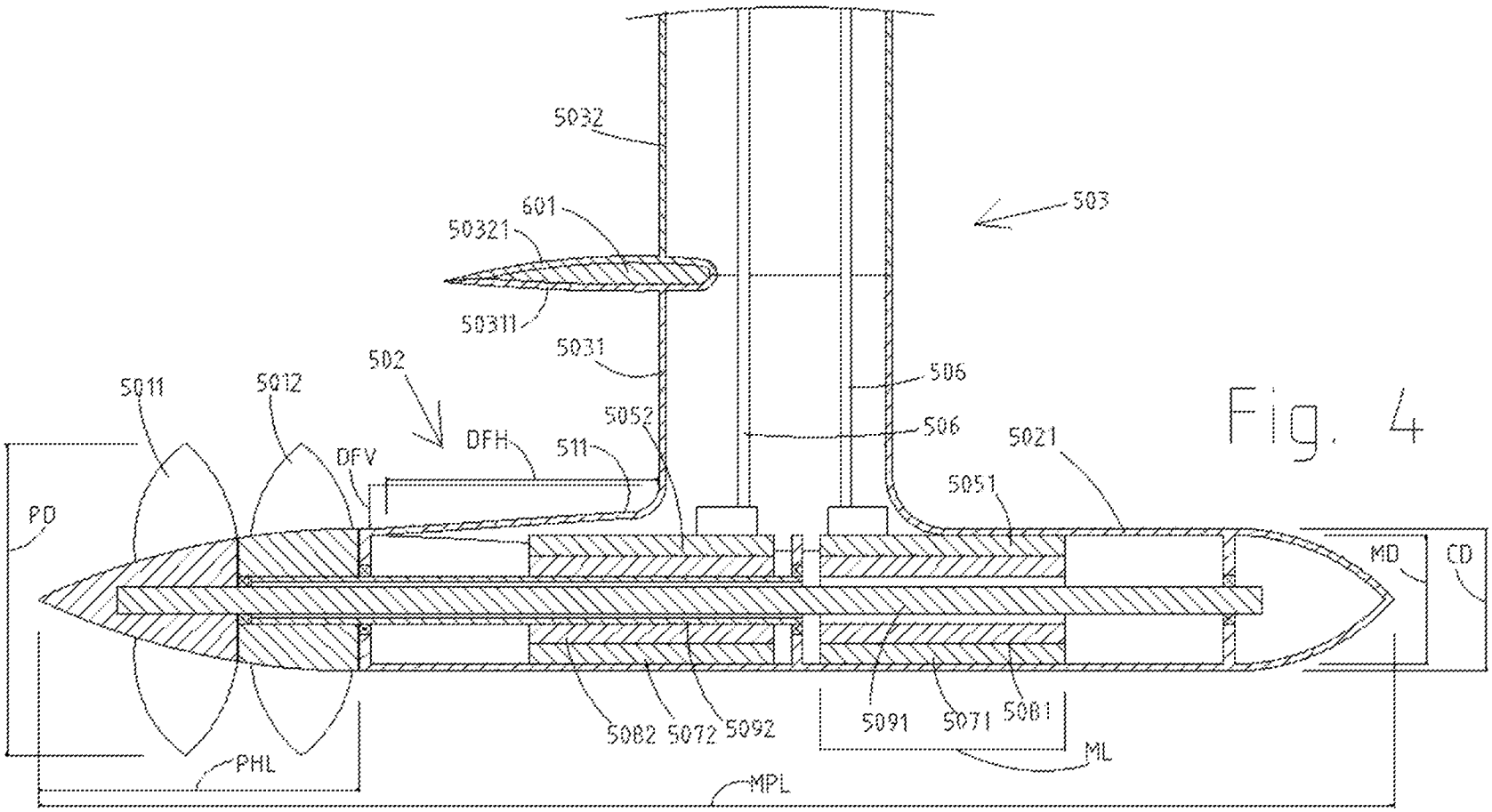

Reference is made also to FIG. 4. The motor pod comprises a casing 5021. The casing has a cylindrical outer surface. The diameter CD of the casing outer surface is in this example 105 mm. Two electric motors 5051, 5052 are housed coaxially in the casing. Two propellers 5011, 5012 are each arranged to be driven by a respective of the motors. The diameters PD of the propellers 5011, 5012 are in this example about 230 mm. The propellers 5011, 5012 are counter-rotating. The propellers are located behind the motors, as seen in a direction of straight forward travel of the boat. The propellers are pushing propellers. In some embodiments, the aft propeller may have a smaller diameter than the forward propeller. The propellers comprise blades which are mounted on propeller hubs. The combined length PHL of the propeller hubs is in this example about 240 mm.

In some embodiments, the propellers are pulling propellers. Thereby, the propellers are located in front of the motors, as seen in a direction of straight forward travel of the boat.

The motors are arranged to be powered by a power source such as a battery pack 504, shown in FIG. 2. Cables 506 for power and control of the motors are indicated in FIG. 4.

Each motor comprises a stator 5071, 5072. The stator is fixed to an inner surface of the casing 5021. Each motor also comprises a rotor 5081, 5082, fixed to a respective of two propeller shafts, 5091, 5092. An inner shaft 5091 of the shafts connects a forward motor 5051 of the motors to an aft propeller 5011 of the propellers. An outer shaft 5092 of the shafts connects a rear motor 5052 of the motors to a forward propeller 5012 of the propellers. The inner shaft 5091 extends through the outer shaft 5092.

The diameter MD of each motor is in this example 95 mm. The length ML of each motor is in this example 180 mm. The inner shaft has in this example a diameter of 20 mm. The outer shaft has in this example a diameter of 35 mm.

In some embodiments, only one electric motor is housed in the casing, and one propeller is arranged to be driven by the motor.

The strut 503 holding the motor pod 502 is, by means of one or more strut bearings 5033, pivotally connected to a strut mounting arrangement 5034 so that the strut may be turned in relation to the hull. The strut mounting arrangement could be provided in the form of a bracket. The strut mounting arrangement is preferably fixed to the hull. Thereby, the strut with the motor pod may be controlled so as to steer the boat. Preferably, the strut 503 extends 0.7-2.0 meters between the one or more strut bearings and the motor pod 502.

The strut 503 is arranged to be tilted around an axis which is substantially horizontal when the boat is floating in an upright condition, and substantially lateral to a direction of straight travel of the boat. Thereby, the strut may be tilted clockwise or anticlockwise, as seen in the view of FIG. 2.

As can be seen in FIG. 4, the strut 503 comprises a lower strut part 5031 and an upper strut part 5032. The lower strut part extends between motor pod and second hydrofoil 601. The second hydrofoil 601 is mounted between the lower and upper strut parts. The second hydrofoil may be provided as a single component extending between two foil tips. The second hydrofoil is mounted to the strut at a region in the middle between the foil tips. The second hydrofoil extends through the strut. The second hydrofoil is sandwiched between the strut portions. The strut may have a streamlined cross-section, e.g. a foil-shaped cross-section, which could have a symmetrical shape. In this example, a rear portion of the second hydrofoil 601 is located behind a trailing edge of the strut 503. The lower and/or the upper strut parts may present a respective protrusion 50311, 50321 to support the second hydrofoil. The protrusion(s) may follow, in a chordwise direction of the second hydrofoil, the surface of the second hydrofoil. The fastening of the upper and lower strut portions to each other, and to the second hydrofoil, may be done in any suitable manner, e.g. with bolts and/or adhesive.

In some embodiments, a portion of the second hydrofoil 601 may extend behind and/or in front of the strut 503. Thereby, the second hydrofoil may extend partly through the strut.

As illustrated in FIG. 2 and FIG. 4, a trailing edge of the strut 503 merges into a fin 511 on the motor pod 502. The fin gradually decreases in height towards the propellers 5011, 5012. The ratio of the horizontal extension DFH of the fin to the maximum vertical extension DFV of the fin is in this example about 6.

As understood from FIG. 2 and FIG. 3, the motor pod 502 is arranged to be more submerged than the first hydrofoil 301 when the boat is travelling straight forward, and when the hull 2 is carried by the first and second hydrofoils 301, 601.

An aspect of the invention provides a boat according to any one of the following clauses.

1. A boat comprising
   - a hull 2,
   - a first hydrofoil assembly comprising a first hydrofoil 301 and a first fastening arrangement 302, the first hydrofoil 301 being fastened to the hull 2 by means of the first fastening arrangement 302,
   - a second hydrofoil assembly, which is separate from the first hydrofoil assembly, comprising a second hydrofoil 601 and a second fastening arrangement 503, the second hydrofoil 601 being fastened to the hull 2 by means of the second fastening arrangement 503, and a motor pod 502 fixed to the first hydrofoil assembly, or to the second hydrofoil assembly, wherein the motor pod comprises a casing, a power supply assembly housed in the casing, and a propeller arranged to be driven by the power supply assembly.

2. A boat according to clause 1, wherein the casing has a cylindrical outer surface wherein the ratio between the length of the motor pod MPL and the casing outer diameter CD is at least 5, preferably at least 7, for example around 9.5.

3. A boat according to any one of the preceding clauses, wherein the diameter of the propeller 5011, 5012 is 180-350 mm.

4. A boat according to any one of the preceding clauses, wherein the ratio between the length MPL of the motor pod and the diameter MD of the propeller is at least 3.0, preferably at least 3.7, for example 4.3.

5. A boat according to any one of the preceding clauses, wherein the casing has a cylindrical outer surface with a diameter of 80-140 mm.

6. A boat according to any one of the preceding clauses, wherein the power supply assembly comprises one or more electric motors, wherein the casing has a cylindrical outer surface, wherein the ratio between the casing outer diameter CD and the diameter MD of the respective motor is equal to or less than 1.20, preferably equal to or less than 1.15, for example 1.10.

7. A boat according to any one of the preceding clauses, wherein the casing is made in bronze.

8. A boat according to any one of the preceding clauses, wherein the power supply assembly comprises one or more electric motors wherein for each motor the ratio between the length ML of the motor and the diameter MD of the motor is at least 1.4, preferably at least 1.7, for example 1.9.

9. A boat according to any one of the preceding clauses, wherein the power supply assembly comprises one or more electric motors wherein the ratio between the length ML of each motor and the length MPL of the motor pod is at least 0.12, preferably at least 0.15, for example 0.18.

10. A boat according to any one of the preceding clauses, wherein the second fastening arrangement comprises a strut 503 arranged to extend at least partly downwards from the hull 2, the second hydrofoil being fixed to the strut.

11. A boat according to clause 10, wherein the strut is located behind the first fastening arrangement as seen in a direction of straight forward travel of the boat.

12. A boat according to clause 10, wherein the strut is located in front of the first fastening arrangement as seen in a direction of straight forward travel of the boat.

13. A boat according to any one of clauses 10-12, wherein the motor pod 502 is fixed to the strut 503.

14. A boat according to any one of clauses 1-12, wherein the motor pod 502 is fixed to the first fastening arrangement.

15. A boat according to any one of the preceding clauses, wherein a trailing edge of the strut 503 merges into a fin 511 on the motor pod 502, wherein the ratio of the horizontal extension DFH of the fin to the maximum vertical extension DFV of the fin is at least 1.5.

Where a stator of the motor is in contact with the casing, the ratio between the casing outer diameter CD and the diameter MD of the respective motor being equal to or less than 1.20, provides for an effective cooling of the motor by a relatively thin wall of the casing. Where a stator of the motor is in contact with the casing, and the casing is made in bronze, with the relatively high heat conductivity of bronze, the casing may provide an effective cooling of the motor.

Figure 5:
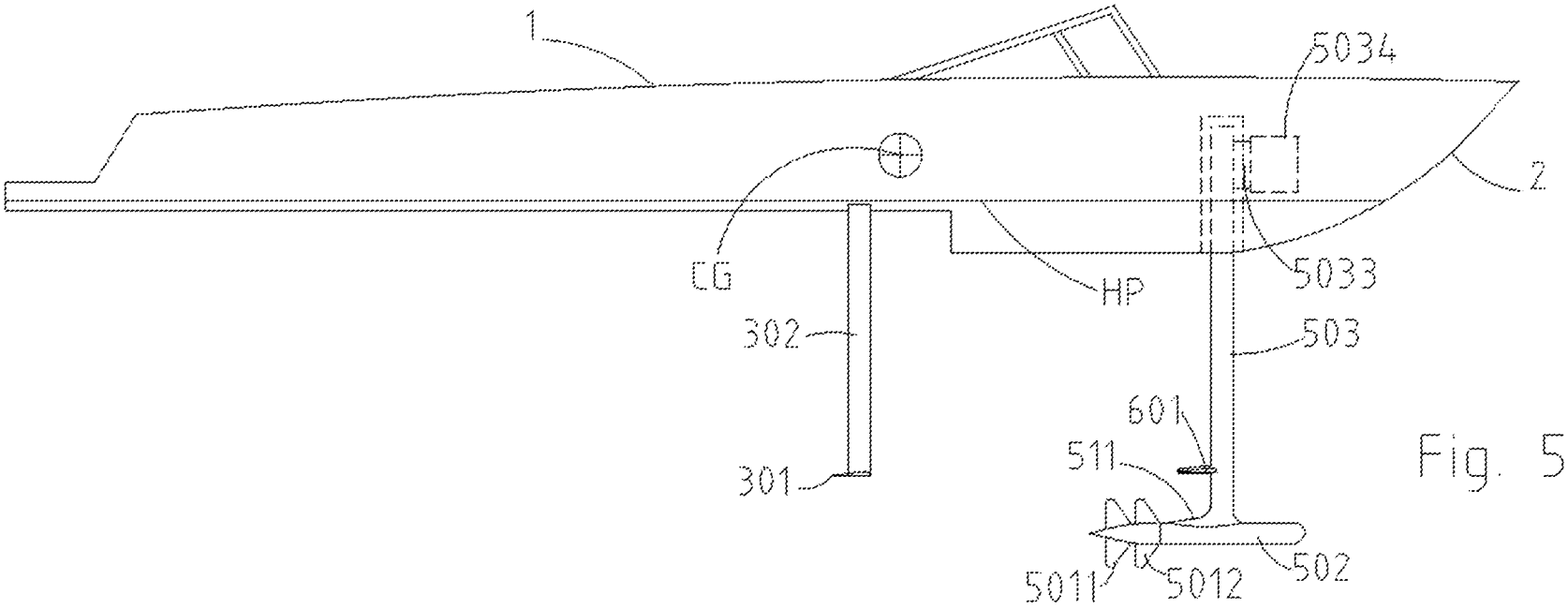

An embodiment where the second fastening arrangement comprises a strut 503 located behind the first fastening arrangement as seen in a direction of straight forward travel of the boat, is illustrated in FIG. 1-3. An embodiment where the strut 503 is located in front of the first fastening arrangement 302 as seen in a direction of straight forward travel of the boat, is illustrated in FIG. 5.

Regardless whether the strut 503 is located behind or in front of the first fastening arrangement, the boat may comprise a strut mounting arrangement 5034 for fixing the strut 503 to the hull 2, wherein the strut is, by means of one or more strut bearings 5033, pivotally connected to the strut mounting arrangement so that the strut and the motor pod may be turned in relation to the hull so as to steer the boat.

The strut 503 may extend 0.7-2.0 meters between the one or more strut bearings and the motor pod 502. The strut may be arranged to be tilted around an axis which is substantially horizontal when the boat is floating in an upright condition, and substantially lateral to a direction of straight travel of the boat. The second hydrofoil 601 may be located above the motor pod 502 when the boat is floating in an upright condition. However, in some embodiments, the second hydrofoil 601 and the motor pod 502 are at the same position along the strut. The strut may comprise a lower strut part and an upper strut part, the second hydrofoil being mounted to the strut, between the lower and upper strut parts. The second hydrofoil 601 may be provided as a single component extending between two foil tips.

It should be noted that within the scope of the clauses, the second fastening arrangement may comprise two or more struts for holding the second hydrofoil.

Figure 6:
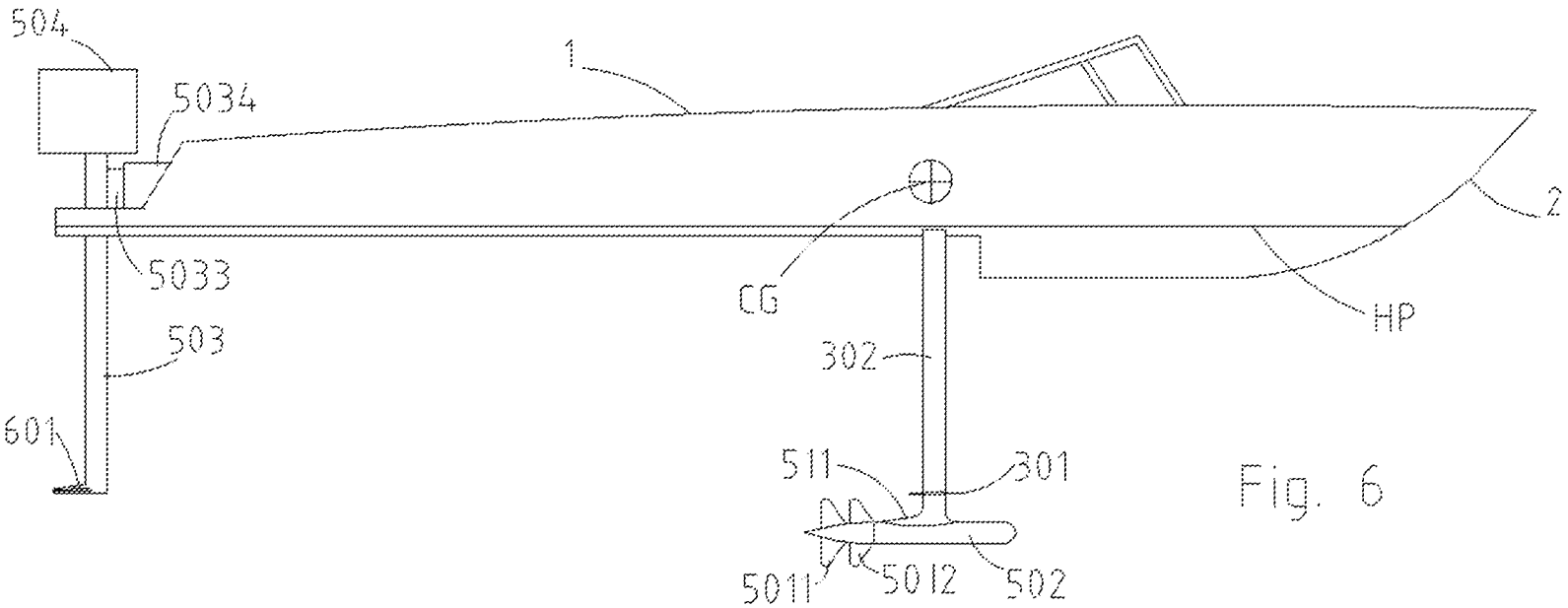

An embodiment where the motor pod 502 is fixed to the first hydrofoil 301 is exemplified in FIG. 6. In some embodiments, e.g. where the first fastening arrangement 302 comprises a single strut, the motor pod 502 may be fixed to the strut.

It is understood that boat according to the clauses above may be provided in a variety of ways. For example, the power supply assembly may comprise two electric motors housed coaxially in the casing. The two propellers 5011, 5012 may each be arranged to be driven by a respective of the motors. The propellers 5011, 5012 may each be arranged to be driven directly by a respective of the motors without a gear arrangement. The motors may be positioned one after the other in a longitudinal direction of the motor pod. This is exemplified in FIG. 4. The propellers 5011, 5012 are preferably counter-rotating.

However, in some embodiments, the motor pod may comprise a single propeller arranged to be driven by a single motor.

The motor pod 502 may be arranged to be more submerged than the first hydrofoil 301 when the boat is travelling straight forward, and when the hull 2 is carried by the first and second hydrofoils 301, 601. The first hydrofoil 301 and/or the second hydrofoil may be a submerged type hydrofoil.

It is to be understood that the present invention is not limited to the embodiments described above and illustrated in the drawings; rather, the skilled person will recognize that many changes and modifications may be made within the scope of the appended claims.

The invention claimed is:

1. A boat comprising a hull a first hydrofoil fastened to the hull by means of a first fastening arrangement, and a second hydrofoil fastened to the hull by means of a second fastening arrangement which is separate from the first fastening arrangement, wherein the second fastening arrangement comprises a strut arranged to extend at least partly downwards from the hull, the second hydrofoil being fixed to the strut, wherein the boat comprises a motor pod fixed to the strut, wherein the strut and the motor pod are turnable in relation to the hull for steering the boat, wherein the motor pod comprises a casing, a power supply assembly housed in the casing, and two propellers arranged to be driven by the power supply assembly, wherein the power supply assembly comprises two electric motors housed coaxially in the casing, wherein the propellers are counter-rotating.

2. A boat according to claim 1, wherein the second hydrofoil is located behind the first hydrofoil as seen in a direction of straight forward travel of the boat.

3. A boat according to claim 1, wherein the propellers are each arranged to be driven by a respective of the motors.

4. A boat according to claim 1, wherein the propellers are each arranged to be driven directly by a respective of the motors without a gear arrangement.

5. A boat according to claim 1, wherein the motors are positioned one after the other in a longitudinal direction of the motor pod.

6. A boat according to claim 1, wherein the casing is made in bronze.

7. A boat according to claim 1, wherein the diameters of the propellers are 180-350 mm.

8. A boat according to claim 1, wherein the casing has a cylindrical outer surface with a diameter of 80-140 mm.

9. A boat according to claim 1, wherein the casing has a cylindrical outer surface, wherein the ratio between the length of the motor pod (MPL) and the casing outer diameter (CD) is at least 5, preferably at least 7, for example around 9.5.

10. A boat according to claim 1, comprising a strut mounting arrangement for fixing the strut to the hull, wherein the strut is, by means of one or more strut bearings, pivotally connected to the strut mounting arrangement so that the strut and the motor pod may be turned in relation to the hull so as to steer the boat.

11. A boat according to claim 10, wherein the strut extends 0.7-2.0 meters between the one or more strut bearings and the motor pod.

12. A boat according to claim 1, wherein the strut is arranged to be tilted around an axis which is substantially horizontal when the boat is floating in an upright condition, and substantially lateral to a direction of straight travel of the boat.

13. A boat according to claim 1, wherein the second hydrofoil is located above the motor pod when the boat is floating in an upright condition.

14. A boat according to claim 1, wherein the second hydrofoil and the motor pod are at the same position along the strut.

15. A boat according to claim 1, wherein the strut comprises a lower strut part and an upper strut part, the second hydrofoil being mounted to the strut, between the lower and upper strut parts.

16. A boat according to claim 1, wherein the second hydrofoil is provided as a single component extending between two foil tips.

17. A boat according to claim 1, wherein a trailing edge of the strut merges into a fin on the motor pod, wherein the ratio of the horizontal extension (DFH) of the fin to the maximum vertical extension (DFV) of the fin is at least 1.5.

18. A boat according to claim 1, wherein the motor pod is arranged to be more submerged than the first hydrofoil when the boat is travelling straight forward, and when the hull is carried by the first and second hydrofoils.

19. A boat according to claim 1, wherein the first hydrofoil is a submerged type hydrofoil.

* * * * *